US011577482B2

(12) United States Patent
Giancaterino

(10) Patent No.: US 11,577,482 B2
(45) Date of Patent: Feb. 14, 2023

(54) UNIT FOR CONVERTING A CONTINUOUS WEB SUBSTRATE, AND PACKAGING PRODUCTION MACHINE THUS EQUIPPED

(71) Applicant: BOBST MEX SA, Mex (CH)

(72) Inventor: Lucio Giancaterino, Renens (CH)

(73) Assignee: BOBST MX SA

( * ) Notice: Subject to any disclaimer, the term of this patent is extended or adjusted under 35 U.S.C. 154(b) by 102 days.

(21) Appl. No.: 16/895,367

(22) Filed: Jun. 8, 2020

(65) Prior Publication Data

US 2020/0298436 A1 Sep. 24, 2020

Related U.S. Application Data

(63) Continuation of application No. 14/893,734, filed as application No. PCT/EP2014/001389 on May 22, 2014, now abandoned.

(30) Foreign Application Priority Data

May 29, 2013 (EP) ..... 13002773

(51) Int. Cl.
*B31B 50/16* (2017.01)
*B26D 5/20* (2006.01)
(Continued)

(52) U.S. Cl.
CPC ..... *B31B 50/16* (2017.08); *B26D 5/20* (2013.01); *B26D 7/2628* (2013.01); *B26D 1/40* (2013.01);
(Continued)

(58) Field of Classification Search
CPC ... B31B 50/156; B31B 50/005; B31B 50/102; B31B 50/146; B26D 5/20; B26D 7/2628; B26D 1/40; B26D 7/2642; B26F 1/3826
(Continued)

(56) References Cited

U.S. PATENT DOCUMENTS 3,827,545 A * 8/1974 Buhayar ..... B65H 5/00 198/605
3,926,097 A 12/1975 Santa Maria et al.
(Continued)

FOREIGN PATENT DOCUMENTS

CH 602 462 7/1978
CH 618 660 8/1980
(Continued)

OTHER PUBLICATIONS

International Search Report dated Jul. 28, 2014 issued in corresponding International patent application No. PCT/EP2014/001389.

*Primary Examiner* — Sameh Tawfik
(74) *Attorney, Agent, or Firm* — Ostrolenk Faber LLP

(57) ABSTRACT

A conversion unit converting a first continuous web substrate into a second substrate in the form of converted blanks of predetermined length. On account of cutting tool rotation speed, the web moves at various speeds for cutting the web cut lengths and other aspects of cutting and transport process having a constant input speed. The unit includes a first motorized arrangement for producing a first run driving of the web, a sheeter having rotary tools for cutting the web into blanks, a second motorized arrangement for producing a second run driving of the substrate, the second arrangement being positioned in the immediate proximity of the sheeter, and at least one station having rotary tools for converting the blanks. A speed of rotation of the second arrangement varies during a cycle of rotation of the tools of the sheeter, comprising a phase at constant tangential speed, substantially equal to the speed of rotation of the tools of the sheeter, during which the cut is made, a speed reduction phase, during which a length of the web, dependent on the difference between the length of the blank and an extension of the periphery of the tools, is kept upstream of the second
(Continued)

arrangement, and a speed increase phase, during which the substrate is discharged downstream of the second arrangement.

14 Claims, 6 Drawing Sheets

(51) Int. Cl.

| | |
|---|---|
| ***B26D 7/26*** | (2006.01) |
| *B26F 1/38* | (2006.01) |
| *B26D 1/40* | (2006.01) |
| *B31B 50/10* | (2017.01) |
| *B31B 50/14* | (2017.01) |
| *B31B 50/00* | (2017.01) |

(52) U.S. Cl.
CPC ..... *B26D 7/2642* (2013.01); *B26F 1/3826* (2013.01); *B31B 50/005* (2017.08); *B31B 50/102* (2017.08); *B31B 50/146* (2017.08)

(58) Field of Classification Search
USPC ..... 493/342
See application file for complete search history.

(56) References Cited

U.S. PATENT DOCUMENTS 4,442,742 A * 4/1984 Orlow ..... B26D 1/626 83/303
4,715,847 A * 12/1987 Focke ..... B26F 1/384 83/100
5,024,128 A * 6/1991 Campbell, Jr. ..... B26D 1/626 83/37
5,163,891 A * 11/1992 Goldsborough ..... B26D 7/27 493/324
5,727,367 A * 3/1998 Cahill ..... B65B 19/228 53/208
5,782,183 A 7/1998 Andrews, Jr.
5,857,395 A * 1/1999 Bohm ..... B26D 11/00 493/227
6,179,763 B1 1/2001 Phillips, III
6,207,001 B1 3/2001 Steidinger
6,234,943 B1 * 5/2001 Copin ..... B65D 85/1072 53/51
6,609,997 B1 8/2003 Sardella
6,687,570 B1 * 2/2004 Sussmeier ..... B65H 9/004 271/189
7,404,349 B1 7/2008 Fiske et al.
7,913,989 B2 * 3/2011 Sandahi ..... B41F 13/60 270/47
8,100,038 B2 * 1/2012 Sandahi ..... B65H 35/08 83/156
8,602,957 B2 * 12/2013 Sandahi ..... B41F 13/60 493/359
2005/0247219 A1 11/2005 Giancaterino
2010/0101386 A1 * 4/2010 Jackson ..... B26F 1/0092 83/287

FOREIGN PATENT DOCUMENTS

| | | |
|---|---|---|
| EP | 0 684 200 | 11/1995 |
| EP | 0 742 170 | 11/1996 |
| WO | WO 2010/063353 | 6/2010 |
| WO | WO 2010/066325 | 7/2010 |

* cited by examiner

UNIT FOR CONVERTING A CONTINUOUS WEB SUBSTRATE, AND PACKAGING PRODUCTION MACHINE THUS EQUIPPED

CROSS-REFERENCE TO RELATED APPLICATIONS

The present application is a continuation of U.S. patent application Ser. No. 14/893,734, filed Nov. 24, 2015, which is a 35 U.S.C. §§ 371 national phase conversion of PCT/EP2014/001389, filed May 22, 2014, which claims priority of European Patent Application No. 13002773.3, filed May 29, 2013, the entire contents of each application is incorporated by reference herein. The PCT International Application was published in the French language.

TECHNICAL FIELD

The present invention relates to a unit for converting a first continuous web substrate into a second substrate in the form of blanks. The invention also relates to a packaging production machine equipped with a unit for converting a continuous web substrate into blanks.

TECHNICAL BACKGROUND

A packaging production machine is intended for the manufacture of boxes, which then form the packaging, after folding and gluing. In this machine, a first initially planar substrate, such as a planar continuous web of cardboard, is unwound and is printed by a print unit, which is itself formed of sub-units in the form of printing units.

The printed web is then transferred to a conversion unit producing in particular at least one of the following conversions: a cutting of the web into blanks, a cutting of the blanks into boxes, an embossing, a creasing, a stripping of the waste from the cutting process. A blank is formed of a number of boxes, which can be interconnected by nicks forming bridges made of the same material as the blank and the boxes.

The blanks obtained are then separated into individual boxes. The boxes are then arranged shingled, before being stacked in rows so as to form piles in a delivery and palletizing station for the purpose of storage of the boxes or their transport from the production machine.

All the conversions are performed in line or sequence in the conversion unit with successive conversion stations driven synchronously. Each station comprises rotary cylinders arranged in pairs. A rotary cylindrical upper tool, usually the male tool, cooperates with precision with a rotary cylindrical lower tool, known as the female tool. The web passes through the radial gap between the upper tool and the lower tool.

The shaping and the circumference of each type of the tools are linked to the type of conversion procedure to be performed by the tools. The circumference of each type of tool is an integer multiple of the length of each box. This implies that each pair of tools is devoted to and usable only for the conversion procedure for which it has been designed.

A tool has to be controlled long in advance of its operation, which is incompatible with the production changes currently required during the conversion. Moreover, a tool is very costly and is only profitable for producing extremely high production quantities.

PRIOR ART

Document U.S. Pat. No. 3,926,097 describes a unit for carrying out conversions on a web substrate, while making it possible to use the same cylinders whatever may be the desired blank length in this unit, a first pair of tools forming a sheet cutter, also known as a "sheeter" makes a frontal cut, which allows the blank to be detached from the rest of the web. The unit then comprises at least one station including respective conversion tools that convert the blank that has just been separated and is arranged downstream of the sheeter.

The tools of the sheeter and the conversion tools are obtained by assembling machined sheet steel plates to a metal cylinder, thus giving the male and/or female cutting and/or conversion shape. The plates are wrapped around and then attached to their respective cylinders by welding or by magnetic fixing.

This solution using plates is less costly and can be implemented more quickly if the procedure is changed in order to convert new blanks. The cylinders are not disassembled with each conversion procedure change. The cylinders instead serve merely to support numerous different plates each devoted to anticipated conversion procedures. Compared with cylinders, the plates are lighter and can thus be handled more easily by the operators. This solution combines the throughputs obtained thanks to the uninterrupted rotary web supply for conversion with the flexibility of the die cutting conversion tools.

In order to achieve detachment of the blank, the web is introduced in the unit by a loop control section that supplies the web to the unit at a clocked speed. The tools of the sheeter rotate at the same speed as the conversion tools. The plates of the sheeter and of the conversion tool cover only an angular sector of the periphery of the cylinders. Each pair of tools thus has an active angular sector, with which it performs its cutting or conversion procedure, and an inactive angular sector.

A pair of drive rolls is provided upstream of the sheeter. These drive rolls are driven at a constant speed. These drive rolls rotate at a speed slightly higher than the maximum speed provided to the web by the loop control section at clocked speed. This overspeed makes it possible to maintain the tension of the web during the operation of the sheeter.

However, there is a risk that the drive rolls will slide over the surface of the web. The printed surface or the lacquer on the surface of the web may become damaged, or the material forming the web will rip. In addition, due to the excessive speed of the drive rolls when the speed of the loop control section is at its minimum, the web is regularly over-tensioned, which may change its resilience. This leads to register losses between the printing and the cutting and the subsequent conversion or conversions.

SUMMARY OF THE INVENTION

The primary object of the present invention lies in providing a conversion unit for converting a first continuous web substrate into a second substrate in the form of converted blanks. A second object is to produce a unit for converting a continuous web into blanks of a predetermined length using conversion cylinders of which the overall peripheral extension is greater than the length of a blank or the length of the format of the boxes constituting a blank. A third object is to overcome the technical problems mentioned for the prior art unit. A further object is that of successfully inserting a conversion unit into a packaging production machine.

A conversion unit is used to convert a first continuous web substrate into a second substrate in the form of converted blanks of a predetermined length. The continuous web is fed at a constant speed into the conversion unit. The conversion unit comprises:

- a first motorized arrangement for producing a first run driving of the first continuous web substrate,
- a sheeter having rotary tools for cutting the first continuous web substrate into a second substrate in the form of blanks,
- a second motorized arrangement for producing a second run driving of the substrate, the second motorized arrangement being positioned in the immediate proximity of the sheeter having rotary tools, and
- at least one station having rotary tools for converting the second substrate in the form of blanks into converted blanks.

In accordance with one aspect of the present invention the conversion unit is characterized in that a speed of rotation of the second motorized arrangement varies during a cycle of rotation of the rotary tools of the sheeter, the speed rotation comprising:

- a phase at constant tangential speed, substantially equal to the speed of rotation of the rotary tools of the sheeter; and during this phase at constant tangential speed, the first continuous web substrate is cut by the sheeter;
- a speed reduction phase during which a length of the first continuous web substrate is kept upstream of the second motorized arrangement; this length of the first continuous web substrate is dependent on the difference between the predetermined length of the blank and a peripheral extension or the total circumference of the conversion tools, and
- a speed increase phase during which the substrate is discharged downstream of the second motorized arrangement.

The conversion is defined, in a non-limiting example, as being a cutting, a creasing, an embossing, a metallization by hot stamping, a gluing of labels or of holograms, a stripping of waste cut out beforehand, and yet others. The upstream and downstream directions are defined with reference to the running direction of the substrate in the conversion unit and in the packaging production machine.

In other words, the clocked speed of the second motorized arrangement imposes the same clocked speed on the substrate, which makes it possible to hold and guide the substrate before, during and after the cutting procedure performed by the sheeter. The second motorized arrangement has an active role of holding the substrate, which is a continuous web, i.e. forming the first substrate, or is a blank, i.e. forming the second substrate. The modulation of speed also makes it possible to adapt the speed of the substrate to that of the sheeter in a first phase and to that of the conversion tools in a second phase.

If one or more printer groups are arranged before the conversion unit, as applies to the majority of prior art machines, the peripheral extension of the conversion cylinders matches the rate of repetition of the printed design, i.e. the printed format of the blanks. In the present invention, the format of the tools is greater than the repetition of the printed format.

The substrate is defined, in a non-limiting example, as being formed of a continuous web material, such as paper, flat cardboard, corrugated cardboard, laminated corrugated cardboard, flexible plastic, for example polyethylene (PE), polyethylene terephthalate (PET), bioriented polypropylene (BOPP), or other materials.

In a further aspect, the invention also relates to a packaging production machine, comprising a unit having one or more technical features described and claimed hereinafter.

BRIEF DESCRIPTION OF THE DRAWINGS

The invention will be understood and its various advantages and different features will become clearer upon reading the following description of a non-limiting exemplary embodiment provided with reference to the accompanying schematic drawings, in which.

DETAILED DESCRIPTION OF PREFERRED EMBODIMENTS

Figure 1:
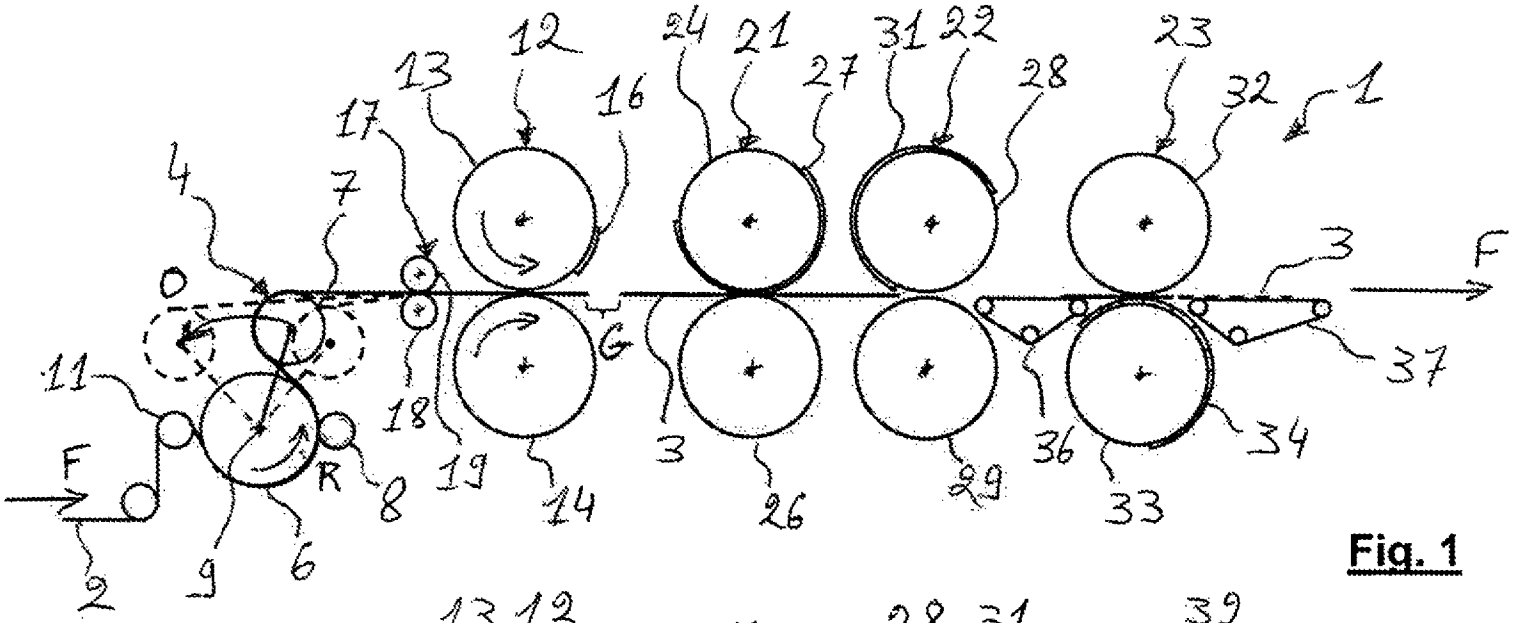
FIG. 1 shows a synoptic side view of a unit for converting a substrate in accordance with a first embodiment of the invention.

As illustrated in FIGS. 1 to 3, 6, 7, 9 and 10, a unit for converting a substrate 1 converts a first substrate, in this case a continuous cardboard web 2. The web 2 enters the unit 1 via its transverse upstream side, which is at the left in the Figures. The unit 1 cuts and converts the web 2 and delivers a second substrate in the form of converted blanks 3, consequently formed of flat cardboard. The blanks 3 exit the unit 1 via its downstream transverse side. The direction of feed or of run driving (from left to right, shown by arrows F in the Figures) of the web 2 and of the blanks 3 in the longitudinal direction indicates the upstream direction and the downstream direction in the unit 1.

A packaging production machine comprises the conversion unit 1. Upstream of the conversion unit 1, the packaging production machine (not visible in the figures) has, by way of example, an unwinding drum, a printing unit with at least one printer group, and means for controlling the quality and the register. A lateral guidance of the web can be used to correct, where necessary, the lateral register of the web 2. A distributor roll is intended to establish a constant tension of the web 2.

In a first embodiment of the invention (FIGS. 1 to 3), the conversion unit 1 may firstly comprise, upstream, a first motorized drive arrangement 4 for run driving the web 2 in a clocked manner in the longitudinal direction F. The web 2 arrives from the printing unit and from the printer group at constant speed. The first motorized arrangement 4 advantageously may be a loop control arrangement.

The loop control arrangement may favorably comprise a traction system, i.e. a primary drive roll 6, also known as a "feathering drive". Combined with the primary roll 6, the loop control arrangement may comprise a loop control, i.e. a satellite roll 7.

The primary drive roll 6 is driven in rotation and turns (arrow R in FIG. 3) on a primary shaft 9 driven by a primary electric drive motor. The primary shaft 9 and thus the primary roll 6 are mounted substantially horizontally and perpendicularly to the direction of run driving of the web 2. The primary roll 6 thus drives the web 2 continuously from upstream to downstream. A press roll 8 keeps the web 2 positioned against the traction system 6. The first motorized arrangement 4 comprises upstream an introduction roll 11, similar to a press roll, ensuring the tension of the belt 2 at the input.

The loop control is a satellite roll 7 mounted in a manner coupled in parallel to the primary roll 6. The web 2 is engaged between the primary roll 6 and the satellite roll 7. The web 2 is held there and can be driven at the same time. The web 2 travels over a path accounting for approximately three quarters of the revolution of the primary roll 6 and half the revolution of the satellite roll 7.

The satellite roll 7 is able to oscillate (arrow O in FIGS. 1 and 3) about the primary roll 6, from upstream to downstream and conversely from downstream to upstream. Two end positions of the satellite roll 7 are shown in dashed lines in FIG. 1.

The amplitude of the oscillations O determines the kept and accumulated lengths of web 2 corresponding to the future blanks 3. The frequency of the oscillations O of the satellite roll 7 generates variations of speed of the web 2. The web 2 passes cyclically from a constant speed to a zero speed, and conversely from a zero speed to a constant speed. These variations of speed and the frequency of the oscillations (O) are selected in accordance with the speed of the cutting and conversion that follows. Examples for the first motorized arrangement 4 are known from documents CH-602.462, CH-618.660, EP-742.170 and WO-2010/063'353.

The conversion unit 1 then comprises a sheeter 12 for cutting the web 2 into successive blanks 3. The sheeter 12 is positioned downstream of the first motorized arrangement 4. The sheeter 12 comprises an upper cutting tool 13 and a smooth lower tool 14, forming a counter-tool, also known as an anvil.

The cutting tool 13 turns at the same speed as the lower tool 14. The two tools 13 and 14 are motorized, by one or two independent motors. In the first embodiment a speed of rotation of the tools 13 and 14 of the sheeter 12 is preferably constant and greater than the speed at which the web 2 is fed into the unit 1.

A frontal cutting plate 16 is fixed to the surface of the cylinder of the upper cutting tool 13. The plate 16 is equipped with cutting threads. The plate 16 has a transverse length substantially equal to the width of the web 2. The plate 16 with its threads extends over a sector of small angular dimension over the cylinder. The threads have a zigzag shape, which is dependent on the shape of the front edge of the blank 3 and on the shape of the rear edge of the preceding blank. The web 2 is driven in the longitudinal direction F only when it is in contact with the cutting plate 16.

In the first embodiment of the invention (FIGS. 1 to 3), the conversion unit 1 also comprises a second motorized drive arrangement 17 for driving the web 2 in the longitudinal direction F. This second motorized arrangement 17 can be positioned in immediate proximity, and in this case in proximity to and upstream of the sheeter 12. This second arrangement 17 may advantageously be inserted between the first motorized arrangement 4 and the sheeter 12.

The second motorized arrangement 17 may preferably comprise a lower drive roll 18 driven in rotation by an electric drive motor. The second motorized arrangement 17 may also comprise upper press means for pressing the web 2 against the drive roll 18. These press means may comprise a single upper pressure roller or a series of upper pressure rollers 19. The drive roll 18 and the upper pressure roller(s) 19 form a system of intake or pinch rollers, which makes it possible to hold and guide the web 2. This web 2 is engaged, held, pinched and driven between the drive roll 18 and the pressure rollers 19. The second motorized arrangement 17 may be of the type described in document WO-2010/066325.

The unit 1 then comprises at least one station for converting the blanks 3, wherein the station has rotary tools. In the three embodiments shown in FIGS. 1 to 3, 6, 7, 9 and 10, three stations 21, 22 and 23 are used. The three stations 21, 22 and 23 are arranged in line, one after the other, and the blanks 3 are converted successively.

A first conversion station may be an embossing station 21 for the blanks 3, is positioned downstream of the sheeter 12. The embossing station 21 comprises an upper male embossing tool 24 and a lower female embossing tool 26, which turn at the same speed. The two embossing tools 24 and 26 are motorized.

A male embossing plate 27 is fixed to the surface of the cylinder of the upper embossing tool 24. The plate 27 is equipped with a male embossing die, having a shape that corresponds to the layout of the blank 3 and of the desired embossed boxes. The plate 27 with its male die extends over all or part of the surface of the cylinder of the upper embossing tool 24.

Similarly, a female embossing plate (not shown) is fixed to the surface of the cylinder of the lower embossing tool 26. The female embossing plate is equipped with a female embossing die shaped complementary to the male embossing die and corresponding to the layout of the blank and of the desired embossed boxes. The female plate with its female die also extends over an angular sector of dimensions substantially equal to those of the male plate 27. The web 2 is driven in the longitudinal direction F only when it is in contact with the male and female embossing plates 27.

A second conversion station may be a creasing and cutting station 22, for creasing folds of the blanks 3, cutting out the blanks 3 and to thus obtain the boxes. The creasing and cutting station 22 is positioned downstream of the embossing station 21. The creasing and cutting station 22 comprises an upper male creasing and cutting tool 28 and a lower female creasing and cutting tool 29. The upper creasing and cutting tool 28 turns at the same speed as the lower creasing and cutting tool 29. The two creasing and cutting tools 28 and 29 are motorized.

A male creasing and cutting plate 31 is fixed on the surface of the cylinder of the upper creasing and cutting tool 28. The male creasing and cutting plate 31 is equipped both with a creasing die and male cutting threads, shaped to correspond to the layout of the blank 3 and of the desired creased and cut boxes. The plate 31, with its die and its male threads extends over all or part of the surface of the cylinder of the upper creasing and cutting tool 28.

Similarly, a female creasing plate (not shown) is fixed to the surface of the cylinder of the lower creasing and cutting tool 29. The female creasing plate is equipped with a female creasing die, shaped complementary to the male creasing die and corresponding to the layout of the blank and of the desired creased and cut boxes. The plate with its female die also extends over a sector of dimensions substantially equal to those of the male plate 31. The web 2 is driven in the longitudinal direction F only when it is in contact with the male and female creasing and cutting plates 31.

A third conversion station may be a waste material removal station 23, to remove areas of waste material present on the blanks 3 and to thus obtain the boxes. The removal station 23 is positioned downstream of the creasing and cutting station 22. The removal station 23 comprises an upper removal tool 32 and a lower removal tool 33, which turn at the same speed. The two removal tools 32 and 33 are motorized.

A removal sector 34 is fixed to the surface of the cylinder of the lower removal tool 33. The sector 34 is equipped with a series of radial needles capable of sinking into each piece of cut waste material. The needles separate the waste materials from the blank 3 by entraining these materials with the rotation of this lower tool 33 equipped with needles. The needles are positioned on the sector 34 and thus on the lower tool 33 in accordance with the layout of the blank 3 and of the desired cut boxes. The sector 34 with its needles extends over all or part of the cylindrical surface of the upper removal tool 32.

Holes are provided at different locations over the entire surface of the upper removal tool 32. The holes can be formed directly in the metal cylindrical body of the upper removal tool 32. The holes can be formed in a soft coating of a vulcanized rubber type covering the surface of the cylinder of the upper removal tool 32. The holes can be formed in a plate then connected on the surface of the cylinder of the upper removal tool 32 or directly on the cylinder in more simple cases. The positions of the holes corresponds to the layout of the blank 3 and of the desired cut boxes and thus to the layout of the needles of the lower tool 33. These needles come to be housed in the holes during the rotation of the two tools 32 and 33, so as to effectively spike the waste material. The upper tool 32 and lower tool 33 ensure the transport of the blanks 3 and the retention thereof during the piercing of the waste material.

This waste material is then released from these radial needles during the rotation of the lower tool 33. To do this, ejectors in the form of fixed cones (not shown) are arranged parallel to the lower tool 33. The radial needles are thus relieved of waste material and the needles thereafter sink into other waste material of the following blank 3 during the next revolution of the lower tool 33.

The conversion station(s) is/are a cutting station 22 for cutting blanks 3 into boxes, and/or an embossing station 21 for embossing blanks 3, and/or a creasing station 22 for creasing blanks 3 and/or a removal station 23 for removing waste material. All the variations are thus possible for the tools 24, 26, 28, 29, 32 and 33 of the conversion station(s) 21, 22 and 23. The first conversion station, i.e. embossing station 21, is optionally formed in accordance with the type of desired boxes. A single station may also comprise both an embossing tool and a creasing tool. One station can be dedicated specifically to creasing and another additional station can be dedicated to the cutting. One station may comprise an upper cutting tool cooperating with a lower removal tool.

The blank 3 cut into boxes attached simply by connection points in the cutting and creasing station 22 is more fragile. The blank 3 is held for its transport to the waste material removal station 23. A first conveyor 36 of the conveyor belt and/or of the vacuum belt type can be inserted between the cutting and creasing station 22 and the waste material removal station 23. The blank 3 cut into boxes attached simply by connection points and without waste material exiting from the waste material removal station 23 is more fragile. The blank 3 is held for its subsequent transport outside the conversion unit 1. A second conveyor 37 of the conveyor belt and/or vacuum belt type can be positioned downstream of the waste material removal station 23.

The packaging production machine may have a blank separator, positioned downstream of the waste material removal station 23 and therefore downstream of the conversion unit 1. The blanks 3 are separated there into individual boxes.

The diameter of the upper tools 24, 28 and 32 and lower tools 26, 29 and 33 is sufficiently large to provide a significant peripheral extension. All the tools 24, 26, 28, 29, 32 and 33 have an equal peripheral extension corresponding to the maximum possible length for the blanks 3. The possibility of converting blanks 3 having different lengths is dependent on the angular sector and therefore on the length of the selected plates 27, 31 and 34.

It is particularly favorable if the rotary tools of the sheet-cutter 12 and/or the rotary tools of the conversion station or of the conversion stations 21, 22 and 33 are mounted in a cassette. With a cassette, the operator can change the tools outside the station and thus outside the packaging production machine. The cassette allows the operator to easily prepare the station for the following operations in accordance with needs, i.e. in accordance with the layout of the blanks and/or of the boxes, alongside ongoing production.

The cassette comprises two upper bearings holding, for rotation, the upper tool 13 or 24 or 28 or 32, and fixed respectively to two lower bearings holding the lower tool 14 or 26 or 29 or 33. The removable cassette can be introduced into a frame of the conversion station and can be fixed to the frame. Conversely, the removable cassette can be uncoupled and removed from said frame.

A speed of rotation of the tools 24, 26, 28, 29, 32 and 33 and of the conversion station(s) 21, 22 and 23 is preferably constant and greater than the speed at which the web 2 is fed into the unit 1. The loop control arrangement 4 enables the speed of the web 2 to be constantly adjusted so as to be adapted to the constant angular speed of the tools of the sheeter 12 and of the conversion station(s) 21, 22 and 23.

Figure 4:
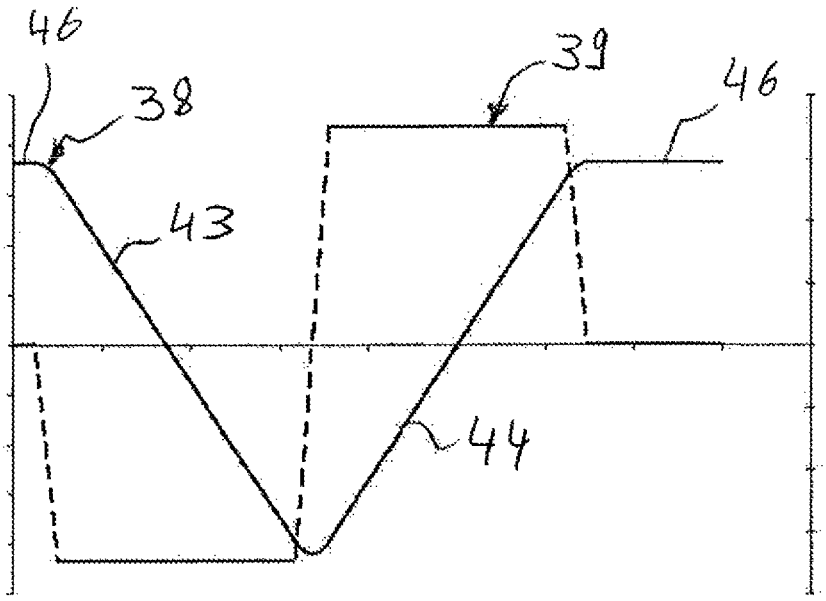
FIGS. 4 and 5 show speed curves as a function of the cycle of rotation of the sheeter for the first embodiment and respectively for a first and a second blank length.
Figure 5:
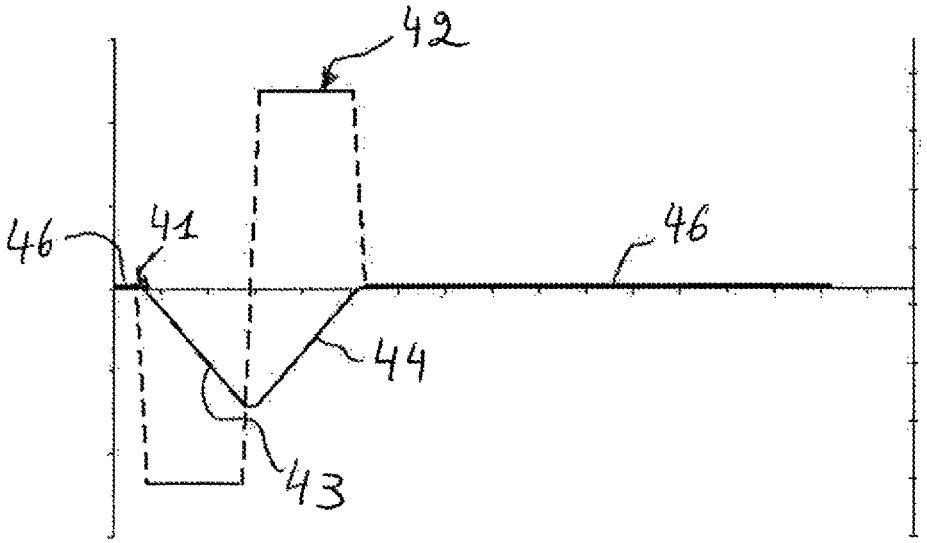
Figure 6:
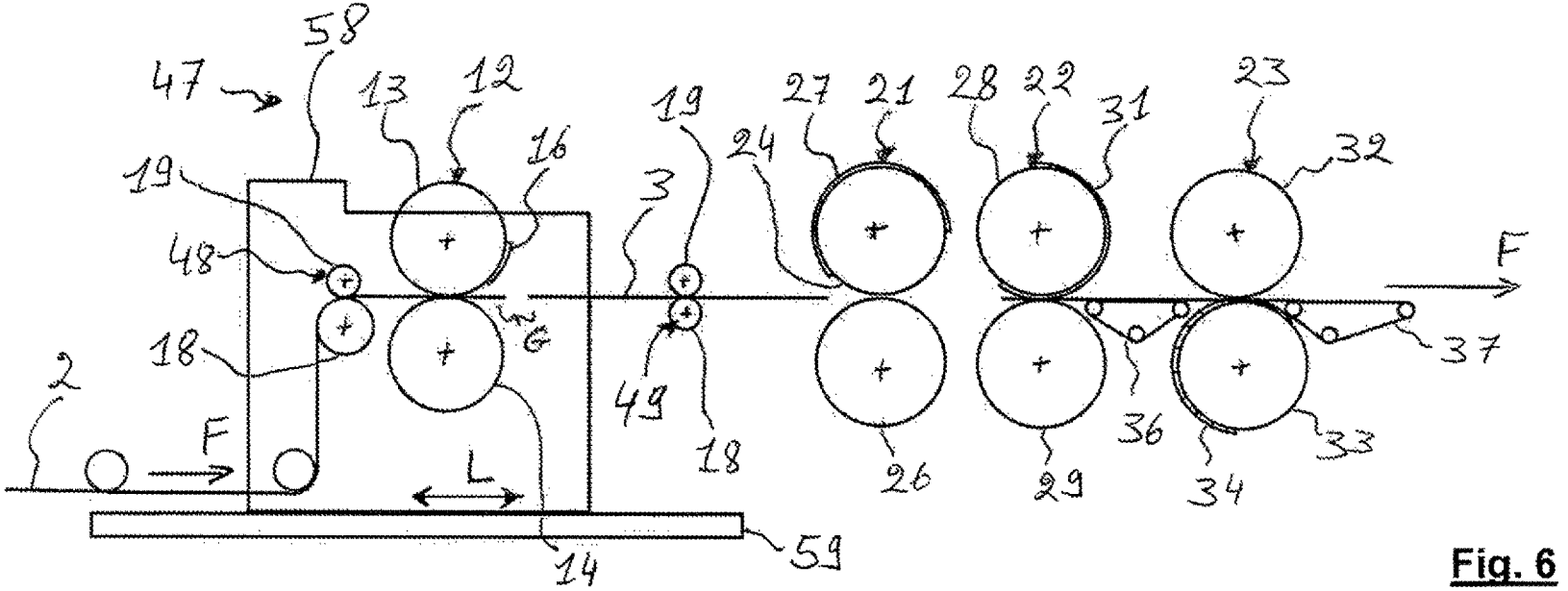
FIGS. 6 and 7 show synoptic side views of a unit for converting a substrate in accordance with a second embodiment of the invention for a first and a second blank length respectively.

In accordance with the invention, the second motorized arrangement 17 has a variable speed profile for the substrate, in this case the web 2. The second motorized arrangement 17 is thus a modulated insertion roll. FIG. 4 concerns the speed profile 38 and the acceleration 39 of the second arrangement 17 for a minimum blank length 3. FIG. 5 concerns the speed profile 41 and the acceleration 42 of the second arrangement 17 for a maximum blank length 3.

In the first embodiment of the invention (see FIGS. 1 to 5), due to the position of the second arrangement 17, a first speed-reduction phase 43 of the second arrangement 17 is implemented after the last cut by the sheeter 12. FIG. 1 shows the relative position of the control loop 4 and the tools 24, 26, 28, 29, 32 and 33 when the cutting tool 13 of the sheeter 12 has just finished cutting the web 2.

In the first phase 43, the control loop 4 starts to retreat with the objective of accumulating the web 2 arriving from the printing unit and of storing the web momentarily before sending it for the cutting process. A determined length of web 2 is accumulated upstream of the second arrangement 17. This length of web 2 is dependent on the difference in length between the length of the blank 3 and the extension of the circumference of the tools 26, 27, 28, 29, 32 and 33.

While the appropriate length of web 2 is gathered, a gap G is thus produced between the web 2 arriving for the following blank and the blank 3 that has just been cut. While the appropriate length of web 2 is gathered, the blank 3 that has just been cut is driven and simultaneously converted by the tools 24, 26, 28, 29, 32 and 33 in the stations 21, 22 and 23. The maximum necessary gap G matches the difference between the length of the blank 3 and the circumference of the tools 24, 26, 28, 29, 32 and 33.

Figure 2:
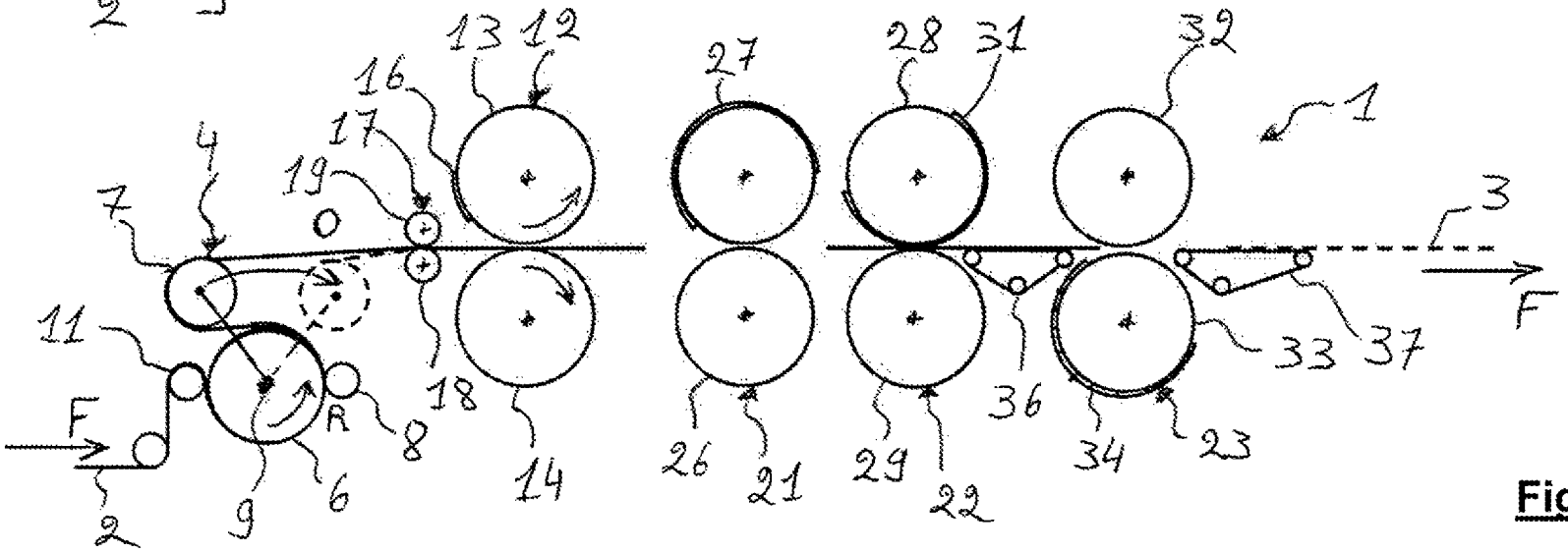
FIGS. 2 and 3 show views of the unit of FIG. 1 with different positions of the tools of the sheeter and of the conversion station respectively.

In the first embodiment of the invention (see FIGS. 1 to 5), due to the position of the second arrangement 17, a second speed increase phase 44 of the second arrangement 17 is implemented before the next cut by the sheeter 12. FIG. 2 shows the relative position of the control loop 4 and of the tools 24, 26, 28, 29, 32 and 33 when the cutting tool 13 of the sheeter 12 is at approximately 30° before the cut of the web 2. In the second phase, the control loop 4 starts to advance (arrow O) with the objective of accelerating the web 2 at the same speed as that of the cutting tool 13. The web 2 is withdrawn downstream of the second arrangement 17.

Figure 3:
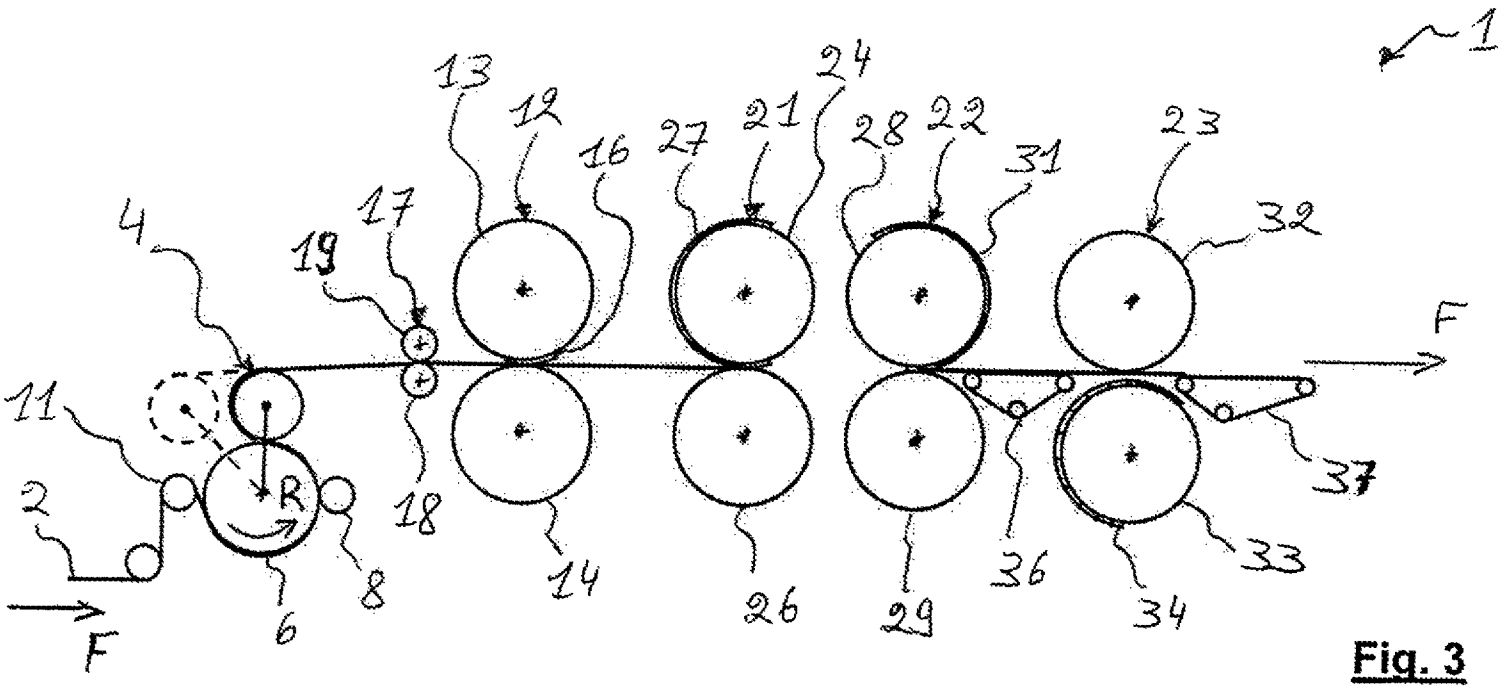

In a third phase 46, the tangential speed of the second motorized arrangement 17 is constant and is substantially equal to the speed of rotation of the tools 13 and 14 of the sheeter 12. The cut is performed during this third phase. FIG. 3 shows the cutting tool 13 of the sheeter 12 in a position in which it is finishing its cutting of the web 2. At this moment, the speed of the web 2 must be the same as the tangential speed of the tools 24, 26, 28, 29, 32 and 33.

In a second embodiment of the invention (see FIGS. 6 and 7), the conversion unit 47 may comprise firstly upstream a first motorized drive arrangement 48. The web 2 arrives from the printing unit and the printer group at constant speed. The first arrangement 48 may advantageously unroll the web 2 at constant speed in the longitudinal direction F. The first arrangement 48 is mechanically substantially similar to the second arrangement 17 described for the first embodiment of the invention.

The sheeter 12 of the second embodiment is mechanically identical to that described for the first embodiment of the invention. In the second embodiment a speed of rotation of the tools 13 and 14 of the sheeter 12 is preferably modulated. The speed of the tools 13 and 14 is constant and must be substantially identical to that of the web 2 at the moment of the frontal cut due to the low angular dimension of the plate 16. The speed of the tools 13 and 14 is variable with acceleration and deceleration in the rest of the perimeter so as to ensure the synchronization in terms of position with the following blank.

In the second embodiment the conversion unit 47 also comprises a second motorized drive arrangement 49 for driving the substrate i.e. the web 2 and the blank 3, in the longitudinal direction F. This second arrangement 49 can be positioned in immediate proximity, and can be positioned in this case in proximity and downstream of the sheeter 12. This second arrangement 49 may advantageously be inserted between the sheeter 12 and the first of the conversion stations 21.

The second arrangement 49 is mechanically substantially similar to the second arrangement 17 described for the first embodiment of the invention. The second arrangement 49 may thus be mechanically similar to the first arrangement 48. The substrate, i.e. the web 2 and the blank 3, is engaged, held, pinched and driven between the lower drive roll 18 and the upper pressure rollers 19.

The three conversion stations 21, 22 and 23 of the second embodiment are identical to those described for the first embodiment of the invention. Similarly to the first embodiment of the invention, the packaging production machine may also have a blank separator positioned downstream of the waste material removal station 23 and therefore downstream of the conversion unit 47. The blanks 3 are separated here into individual boxes.

Figure 8:
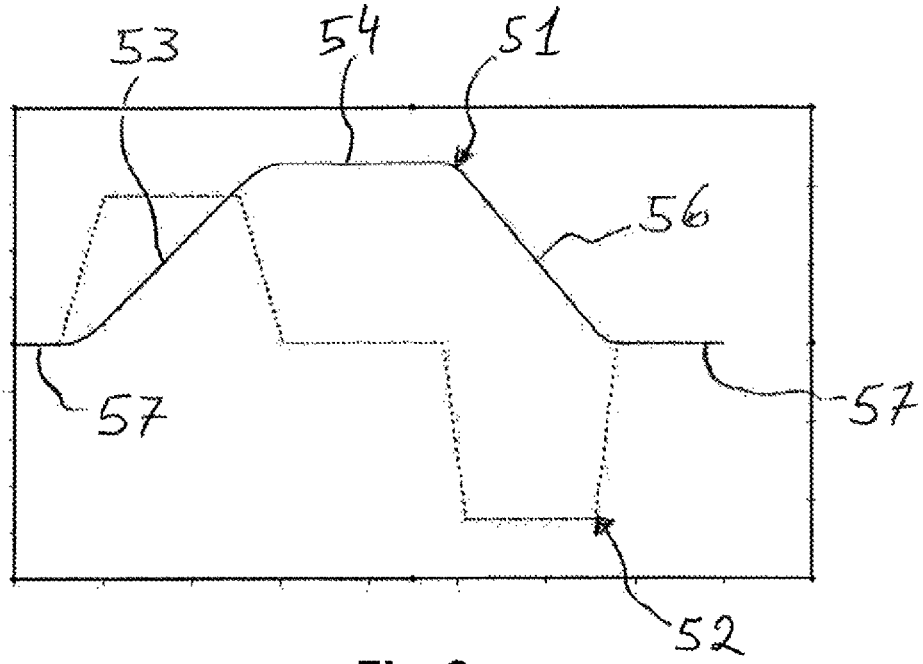
FIG. 8 shows a speed curve as a function of the cycle of rotation of the sheeter for the second embodiment.
Figure 9:
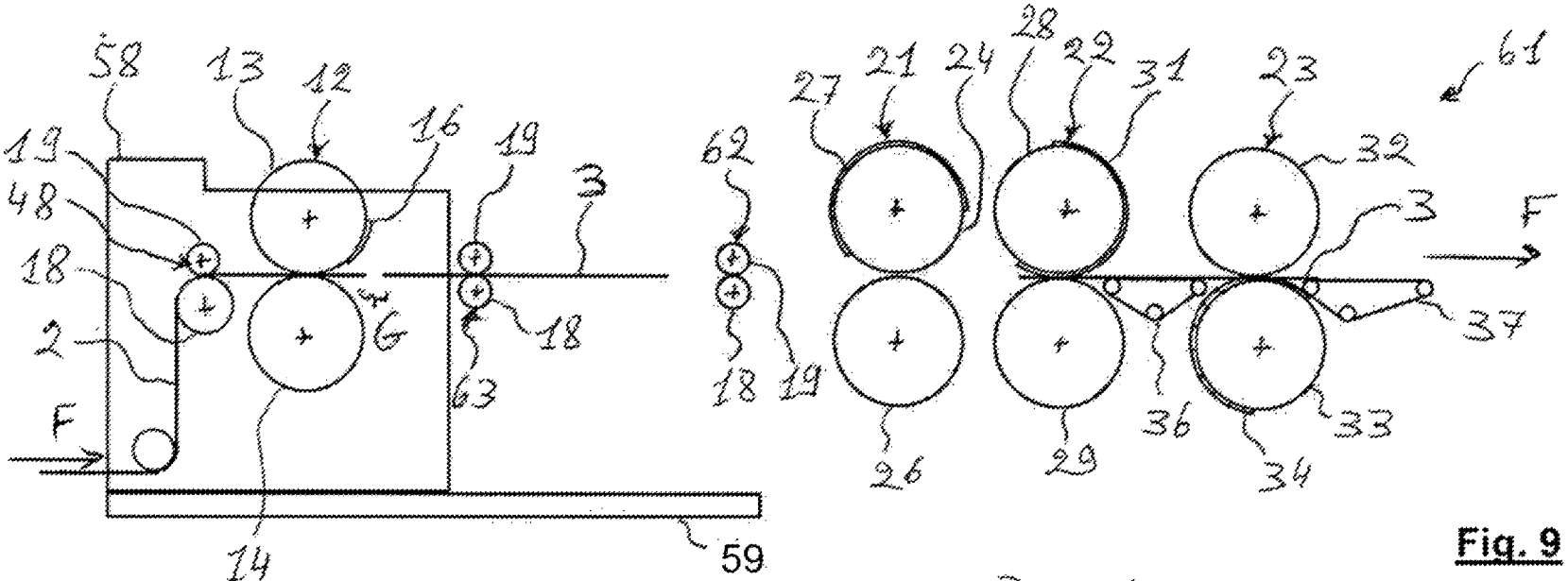
FIGS. 9 and 10 show a synoptic side view of a unit for converting a substrate in accordance with a third embodiment of the invention for a first and a second blank length.

In accordance with the invention, the second motorized arrangement 49 has a variable speed profile for the substrate, in this case the web 2 and the blank 3. The second motorized arrangement 49 is thus a modulated output roll. FIG. 8 concerns the speed profile 51 and the acceleration 52 of the second arrangement 49.

In the second embodiment of the invention (see FIGS. 6 to 8), a first speed increase phase 53 of the second arrangement 49 is implemented after the last cut by the sheeter 12, due to the position of the second arrangement 49.

The blank 3 that has just been cut is accelerated and driven by the second arrangement 49 so as to reach the same speed 54 as that of the tools 24, 26, 28, 29, 32 and 33 of the conversion stations 21, 22 and 23. A gap G is thus produced between the web 2 arriving for the following blank and the blank 3 that has just been cut. The maximum necessary gap G matches the difference between the length of the blank 3 and the circumference of the tools 24, 26, 28, 29, 32 and 33.

In the second embodiment of the invention (see FIGS. 6 to 8), due to the position of the second arrangement 49, a second speed reduction phase 56 of the second arrangement 49 is implemented before the following cut by the sheeter 12. During this speed reduction phase 56, a determined length of web 2 is accumulated upstream of the second arrangement 49. This length of web 2 is dependent on the difference in length between the length of the blank 3 and the extension of the circumference of the tools 26, 27, 28, 29, 32 and 33.

In a third phase 57 the tangential speed of the second arrangement 49 is constant and is substantially equal to the speed of rotation of the tools 13 and 14 of the sheeter 12. The cut is made during this third phase 57.

Figure 7:
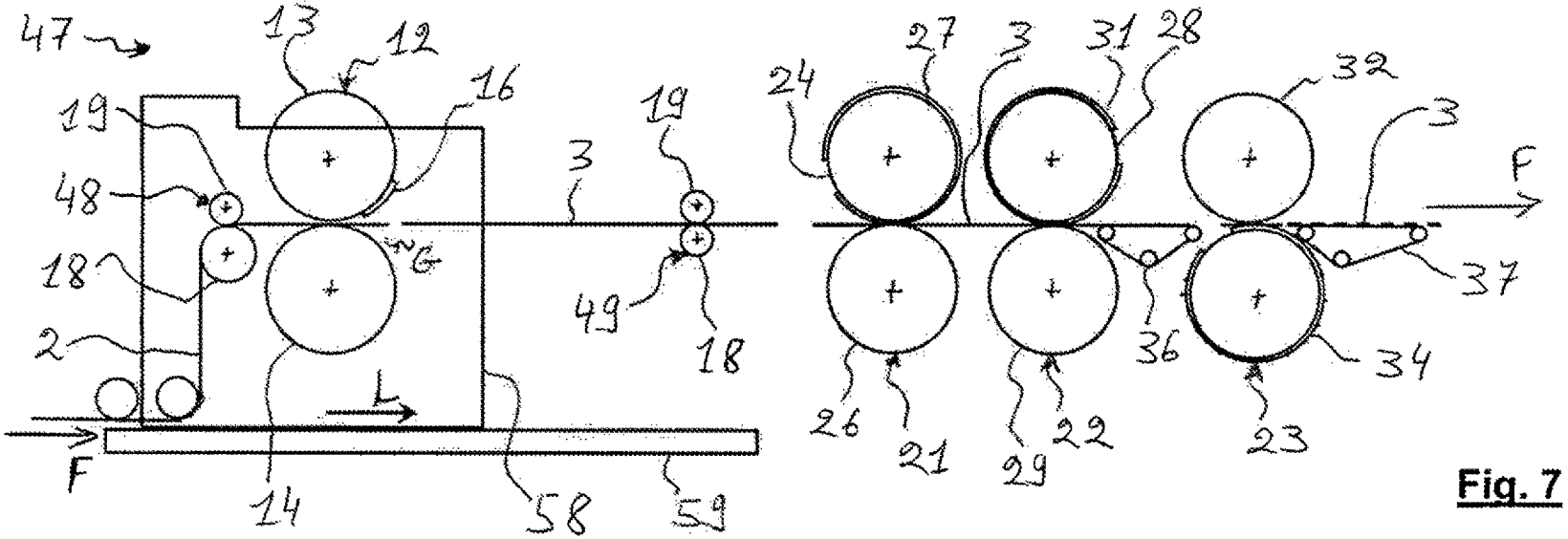

The first arrangement 48 and the sheeter 12 are mounted so as to be longitudinally movable (arrow L in FIGS. 6 and 7), for example in a sliding frame 58 on rails 59 so as to vary the distance between the sheeter 12 and the conversion station 21 depending on the desired length for the blanks 3. FIG. 7 specifically shows the configuration for the maximum length of the blank 3. The frame 58 is in its farthest left-hand position in FIG. 7, the space between the frame 58 and the second arrangement 49 or the first conversion station 21 being open to the greatest possible extent.

In a third embodiment of the invention (see FIGS. 9 and 10), the conversion unit 61 may comprise firstly upstream a first motorized drive arrangement 48. The web 2 arrives from the printing unit and the printer group at constant speed. The first arrangement 48 is mechanically substantially similar to the first arrangement 48 described for the second embodiment of the invention and to the second arrangement 17 described for the first embodiment of the invention. The first arrangement 48 may favorably unroll the web 2 at constant speed in the longitudinal direction F.

The sheeter 12 of the third embodiment is mechanically identical to that described for the first and second embodiments of the invention. In the third embodiment and as for the second embodiment, a speed of rotation of the tools 13 and 14 of the sheeter 12 is preferably modulated.

In the third embodiment the conversion unit 61 also comprises a second motorized drive arrangement 62 for driving the substrate, i.e. the web 2 and the blank 3, in the longitudinal direction F. This second arrangement 62 can be positioned in immediate proximity and can be positioned in this case in proximity and downstream of the sheeter 12.

This second arrangement 62 may advantageously be inserted between the sheeter 12 and the first of the conversion stations 21.

The second arrangement 62 is mechanically substantially similar to the second drive arrangement 17 described for the first embodiment of the invention and to the first motorized arrangement 48. The substrate, i.e. the web 2 and the blank 3, is engaged, held, pinched and driven between the lower drive roll 18 and the upper pressure rollers 19.

The three conversion stations 21, 22 and 23 of the third embodiment are identical to those described for the first and second embodiments of the invention. Similarly to the first and second embodiment of the invention, the packaging production machine may have a blank separator positioned downstream of the waste material removal station 23 and therefore downstream of the conversion unit 61. The blanks 3 are separated here into individual boxes.

In the third embodiment the conversion unit 61 may preferably also comprise a third motorized arrangement 63 for driving the substrate, i.e. the web 2 and the blank 3, in the longitudinal direction F. This third arrangement 63 can be positioned in immediate proximity and can be positioned in this case in proximity and downstream of the sheeter 12. This third arrangement 63 may advantageously be inserted between the sheeter 12 and the second arrangement 62.

The third arrangement 63 is mechanically substantially similar to the second arrangement 17 described for the first embodiment of the invention. The third arrangement 63 may thus be mechanically similar to the first arrangement 48 and to the second arrangement 62. The substrate, i.e. the web 2 and the blank 3, is engaged, held and driven between the lower drive roll 18 and the upper pressure rollers 19.

Figure 10:
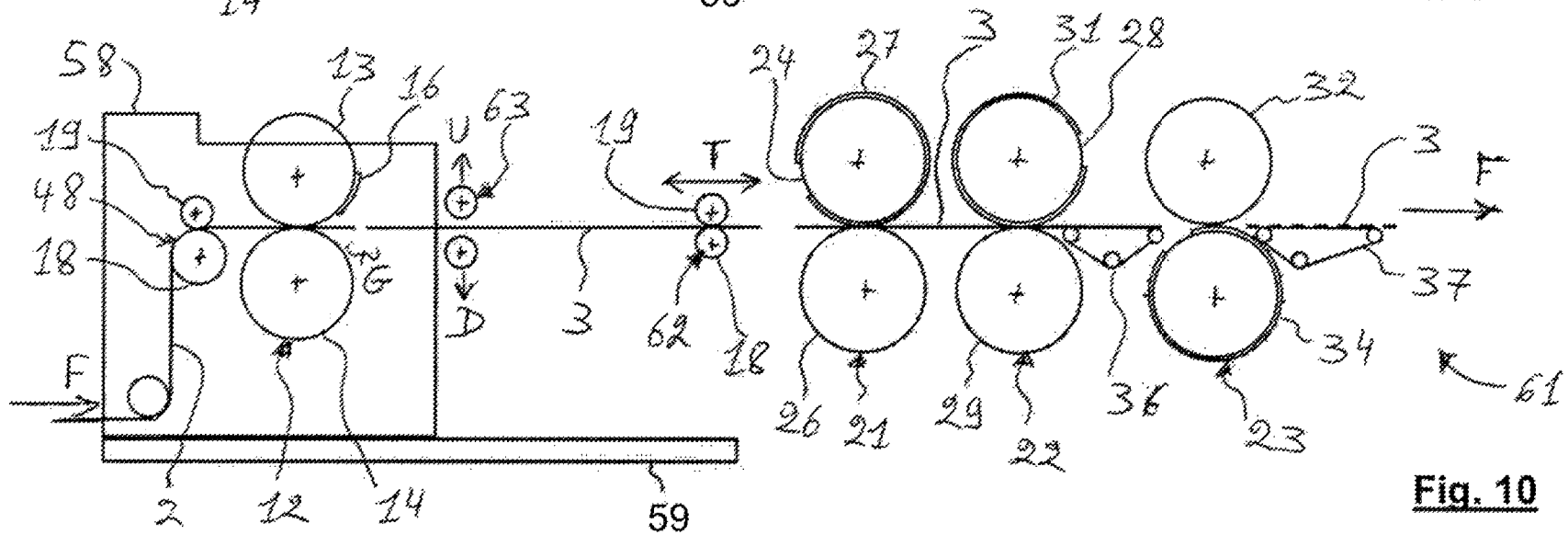

As can be seen in FIG. 10, the second arrangement 62 is mounted so as to be longitudinally movable (arrow T in FIG. 10). This makes it possible to vary the distance between the second arrangement 62 and the sheeter 12 in accordance with the length of the blank 3 or the web 2 constituting the future blank. The first arrangement 48 and the sheeter 12 are mounted in a stationary manner, for example in a frame 58 fixed on a base 64.

FIG. 10 specifically shows the configuration for the maximum length of the blank 3. The third arrangement 63 can thus be disconnected. The third arrangement is deactivated for example by raising the pressure rollers 19 (arrow U in FIG. 10) and by lowering the drive roll 18 (arrow D in FIG. 10), thus making it possible to distance the rollers and roll from the web 2. This makes it possible for only the second arrangement 62 to be providing an active drive, this being dependent on the length of the blank 3 or of the web 2 constituting the future blank.

In accordance with the invention, the second motorized arrangement 62 and/or the third arrangement 63 have a variable speed profile for the substrate, in this case the web 2 and the blank 3. FIG. 8 concerns the speed profile 58 and the acceleration 52 of the second arrangement 62 and/or of the third arrangement 63.

In the third embodiment of the invention (see FIGS. 8 to 10), a first speed increase phase 53 of the second arrangement 62 and/or of the third arrangement 63 is implemented after the last cut by the sheeter 12, due to the position of the second arrangement 62 and/or of the third arrangement 63.

The blank 3 that has just been cut is accelerated and driven by the second arrangement 62 and/or by the third arrangement 63 so as to reach the same speed 54 as that of the tools 24, 26, 28, 29, 32 and 33 of the conversion stations 21, 22 and 23. A gap G is thus produced between the web 2 arriving for the following blank and the blank 3 that has just been cut. The maximum necessary gap G matches the difference between the length of the blank 3 and the extension of the circumference of the tools 24, 26, 28, 29, 32 and 33.

In the third embodiment of the invention (see FIGS. 8 to 10), a second speed reduction phase 56 of the second arrangement 62 and/or of the third arrangement 63 is implemented before the following cut by the sheeter 12, due to the position of the second arrangement 62 and/or of the third arrangement 63. During this speed reduction phase 56, a determined length of web 2 is accumulated upstream of the second arrangement 49. This length of web 2 is dependent on the difference in length between the length of the blank 3 and the circumference of the tools 26, 27, 28, 29, 32 and 33.

In a third phase 57, the tangential speed of the second arrangement 62 and/or of the third arrangement 63 is constant and is substantially equal to the speed of rotation of the tools 13 and 14 of the sheeter 12. The cut is made during this third phase 57.

The present invention relates to three technical solutions aimed at providing the conversion unit 1, 47 and 61, which, on the basis of the continuous web substrate 2, make it possible to arrive at a substrate in the form of a blank 3. The three solutions are aimed at ensuring a constant speed of rotation of the conversion tools 21, 22 and 23, which carry the knives or the other elements for conversion, such as creasing, embossing or waste material removal, in spite of the fact that the format of these tools is generally larger than the repetition of the printed format.

The present invention is not limited to the embodiments described and illustrated. Numerous modifications can be made, without departing from the scope defined by the set of claims.

What is claimed is:

1. A method of operating a conversion unit, the conversion unit converting a continuous web into separated converted blanks of predetermined length, the method comprising:

engaging the continuous web by a first motorized arrangement and driving, as a first run driving, the continuous web at a clocked speed;

receiving from the first motorized arrangement the continuous web by a second motorized rotatable arrangement and driving, by the second motorized rotatable arrangement as a second run driving, the continuous web;

receiving the continuous web from the second motorized arrangement by a sheeter adjacent the second motorized arrangement, and cutting, by rotary tools of the sheeter, the continuous web into separate blanks;

converting, in at least one web conversion station, the separate blanks into the separated converted blanks;

varying a speed of rotation of the second motorized rotatable arrangement in phases, the phases including:

a constant speed phase at a constant tangential speed, which is substantially equal to a speed of rotation of the tools of the sheeter, wherein a cut of the continuous web substrate is made by the sheeter during the constant speed phase of the second motorized arrangement;

a speed reduction phase, during which a length of the continuous web substrate, which length is dependent on the difference between the length of the blank and a peripheral extension of the rotary conversion tools, is kept upstream of the second motorized arrangement; and a speed increase phase, during which the continuous web substrate is discharged downstream of the second motorized rotatable arrangement to the sheeter.

2. The method according to claim 1, wherein the speed of rotation of the rotary tools of the sheeter and of the conversion unit is constant and is greater than the speed at which the web is fed.

3. The method according to claim 1, wherein the method further comprises:

driving in rotation a rotatable drive roll of the second motorized rotatable arrangement; and engaging, holding and driving the continuous web between the rotatable drive roll and press rollers cooperating with the rotatable drive roll.

4. The method according to claim 1, wherein the first motorized arrangement comprises a loop control.

5. The method according to claim 4, wherein the method further comprises:

driving in rotation a primary drive roll of the loop control; and oscillating upstream and downstream a satellite roll of the loop control, the oscillating performed about the primary drive roll; and engaging and holding the continuous web between the primary roll and the satellite roll such that the oscillation passes the continuous web cyclically from a constant speed to a zero speed at the output of the satellite roll.

6. The method according to claim 1, wherein the at least one web conversion station is a station cutting blanks into boxes, or an embossing station embossing the blanks, or a creasing station creasing the blanks, or a waste material removal station removing waste material.

7. The method according to claim 1, wherein at least one of the rotary tools of the sheeter and the conversion station are mounted in a cassette.

8. The method according to claim 1, wherein the converting unit is located between at least one printer group and a cut blank separator of the conversion station.

9. The method according to claim 1, wherein the varying the speed of rotation of the second motorized rotatable arrangement is performed during a cycle of rotation of the rotary tools of the sheeter.

10. The method according to claim 1, wherein the continuous web has a constant feed speed.

11. The method according to claim 1, wherein the speed reduction phase is implemented after a cut of the continuous web substrate by the sheeter, and the speed increase phase is implemented before the cut of the continuous web substrate by the sheeter.

12. The method according to claim 1, wherein the speed reduction phase is implemented before a following cut of the continuous web substrate by the sheeter, and the speed increase phase is implemented after a last cut of the continuous web substrate by the sheeter.

13. The method according to claim 1, further comprising driving the continuous web substrate or the blank with another motorized arrangement located downstream of the sheeter, and varying a speed of rotation of the another motorized rotatable arrangement in phases, the phases including:

a constant speed phase at a constant tangential speed, which is substantially equal to a speed of rotation of the tools of the sheeter, wherein a cut of the continuous web substrate is made by the sheeter during the constant speed phase of the second motorized arrangement;

a speed reduction phase, during which a length of the continuous web substrate, which length is dependent on the difference between the length of the blank and a peripheral extension of the rotary conversion tools, is kept upstream of the second motorized arrangement; and a speed increase phase, during which the continuous web substrate is discharged downstream of the second motorized rotatable arrangement to the sheeter.

14. The method according to claim 13, wherein the speed reduction phase of the another motorized arrangement is implemented before a following cut of the continuous web substrate by the sheeter, and the speed increase phase of the another motorized arrangement is implemented after a last cut of the continuous web substrate by the sheeter.

* * * * *